US011485601B2

(12) United States Patent
Egawa et al.

(10) Patent No.: US 11,485,601 B2
(45) Date of Patent: Nov. 1, 2022

(54) SHEET POST-PROCESSING DEVICE

(71) Applicant: KYOCERA Document Solutions Inc., Osaka (JP)

(72) Inventors: Keisuke Egawa, Osaka (JP); Kazuhisa Iwamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/544,042

(22) Filed: Dec. 7, 2021

(65) Prior Publication Data

US 2022/0185613 A1 Jun. 16, 2022

(30) Foreign Application Priority Data

Dec. 14, 2020 (JP) ..... JP2020-206837

(51) Int. Cl.

| | |
|---|---|
| ***B65H 37/06*** | (2006.01) |
| ***B65H 29/58*** | (2006.01) |
| ***B65H 31/26*** | (2006.01) |
| *B65H 45/04* | (2006.01) |

(52) U.S. Cl.

CPC ..... *B65H 37/06* (2013.01); *B65H 29/58* (2013.01); *B65H 31/26* (2013.01); *B65H 45/04* (2013.01); *B65H 2301/3411* (2013.01); *B65H 2301/45* (2013.01)

(58) Field of Classification Search

None

See application file for complete search history.

(56) References Cited

U.S. PATENT DOCUMENTS

| | | | | |
|---|---|---|---|---|
| 7,681,881 | B2 * | 3/2010 | Kunieda | B65H 31/38 271/220 |
| 8,070,150 | B2 * | 12/2011 | Tanaka | B65H 31/10 270/58.11 |
| 8,177,227 | B2 * | 5/2012 | Uchiyama | B65H 31/10 271/226 |
| 8,251,362 | B2 * | 8/2012 | Konishi | B65H 31/34 270/58.27 |
| 8,256,757 | B2 * | 9/2012 | Imazu | B65H 45/148 270/32 |
| 8,585,032 | B2 * | 11/2013 | Sano | B65H 45/148 493/434 |
| 8,590,880 | B2 * | 11/2013 | Imazu | G03G 15/6582 399/407 |
| 9,085,437 | B2 * | 7/2015 | Shirakura | B65H 45/12 |

(Continued)

FOREIGN PATENT DOCUMENTS

JP 2013-35641 A 2/2013

*Primary Examiner* — Leslie A Nicholson, III
(74) *Attorney, Agent, or Firm* — Stein IP, LLC

(57) ABSTRACT

A sheet post-processing device includes a folding portion, a discharge portion, a stacking tray, a shift unit, a pair of alignment members, and a controller. The pair of alignment members include first and second alignment members at one and the other side of sheets stacked on the stacking tray. When a sheet bundle sorted and stacked on the stacking tray includes a folded sheet, executes a second alignment mode in which it performs, for sheets shifted to a first position at one side on the stacking tray, alignment with only the first alignment member and, for sheets shifted to a second position at the other side, alignment with only the second alignment member, or does not perform alignment process.

6 Claims, 11 Drawing Sheets

(56) References Cited

U.S. PATENT DOCUMENTS

| | | | | |
|---|---|---|---|---|
| 9,102,497 | B2 * | 8/2015 | Tokuma | B65H 31/34 |
| 9,751,274 | B2 * | 9/2017 | Kobayashi | B65H 45/18 |
| 2013/0032992 | A1 | 2/2013 | Sato et al. | 271/220 |

* cited by examiner

SHEET POST-PROCESSING DEVICE

INCORPORATION BY REFERENCE

This application is based on and claims the benefit of priority from Japanese Patent Application No. 2020-206837 filed on Dec. 14, 2020, the contents of which are hereby incorporated by reference.

BACKGROUND

The present disclosure relates to a sheet post-processing device that performs predetermined post-processing on a sheet such as a sheet of paper that has undergone image formation by an image forming apparatus such as a copier or a printer.

Sheet post-processing devices are commonly used that can perform processes such as binding, i.e., stacking a plurality of sheets having images formed on them by an image forming apparatus such as a copier or a printer and then binding the bundle of the stacked sheets together with a staple; punch hole formation, i.e., forming punch holes (perforations) in sheets with a punch hole forming device; and folding, i.e., folding sheets in two or three.

Such a sheet post-processing device includes a pair of discharge rollers for discharging sheets having undergone post-processing and a stacking tray on which the sheets discharged by the pair of discharge rollers are stacked.

SUMMARY

According to one aspect of the present disclosure, a sheet post-processing device includes a folding portion, a discharge portion, a stacking tray, a shift unit, a pair of alignment members, and a controller. The folding portion applies a predetermined folding process to sheets. The discharge portion discharges sheets through a sheet discharge port. On the stacking tray, the sheets discharged through the sheet discharge port are stacked. The shift unit shifts the discharge position of the sheets on the stacking tray in the sheet width direction orthogonal to the discharge direction. The pair of alignment members includes a first alignment member disposed at one side in the sheet width direction so as to be reciprocatable in the sheet width direction and a second alignment member disposed at the other side in the sheet width direction so as to be reciprocatable in the sheet width direction. The pair of alignment members configured to contact the sheet stacked on the stacking tray to align the position of the sheet in the sheet width direction. The controller controls the folding portion, the shift unit, and the pair of alignment members. The controller performs an alignment process in which the controller makes the pair of alignment members reciprocate between a predetermined aligning position and a position outward of the aligning position with respect to the sheet width direction, thereby to align the sheet discharged at a predetermined discharge position on the stacking tray. The controller also performs a sorting process in which the controller, when a plurality of copies of a sheet bundle including a plurality of the sheets are discharged, drives the shift unit to shift the discharge position of the sheet bundle discharged on the stacking tray alternately, for each copy, between a first shift position at one side in the sheet width direction and a second shift position at the other side in the sheet width direction. When the sheet bundle stacked on the stacking tray does not include a sheet subjected to the folding process, executes a first alignment mode in which the alignment process is performed with the first and second alignment members. When the sheet bundle stacked on the stacking tray includes a sheet subjected to the folding process, executes a second alignment mode in which the alignment process is performed, for the sheet bundle shifted to the first shift position, alignment with only the first alignment member and, for the bundle sheets shifted to the second shift position, alignment with only the second alignment member, or does not perform alignment process.

BRIEF DESCRIPTION OF THE DRAWINGS

FIG. 3 is a part sectional view showing the structure around a processing tray in

FIG. 2;

DETAILED DESCRIPTION

Figure 1:
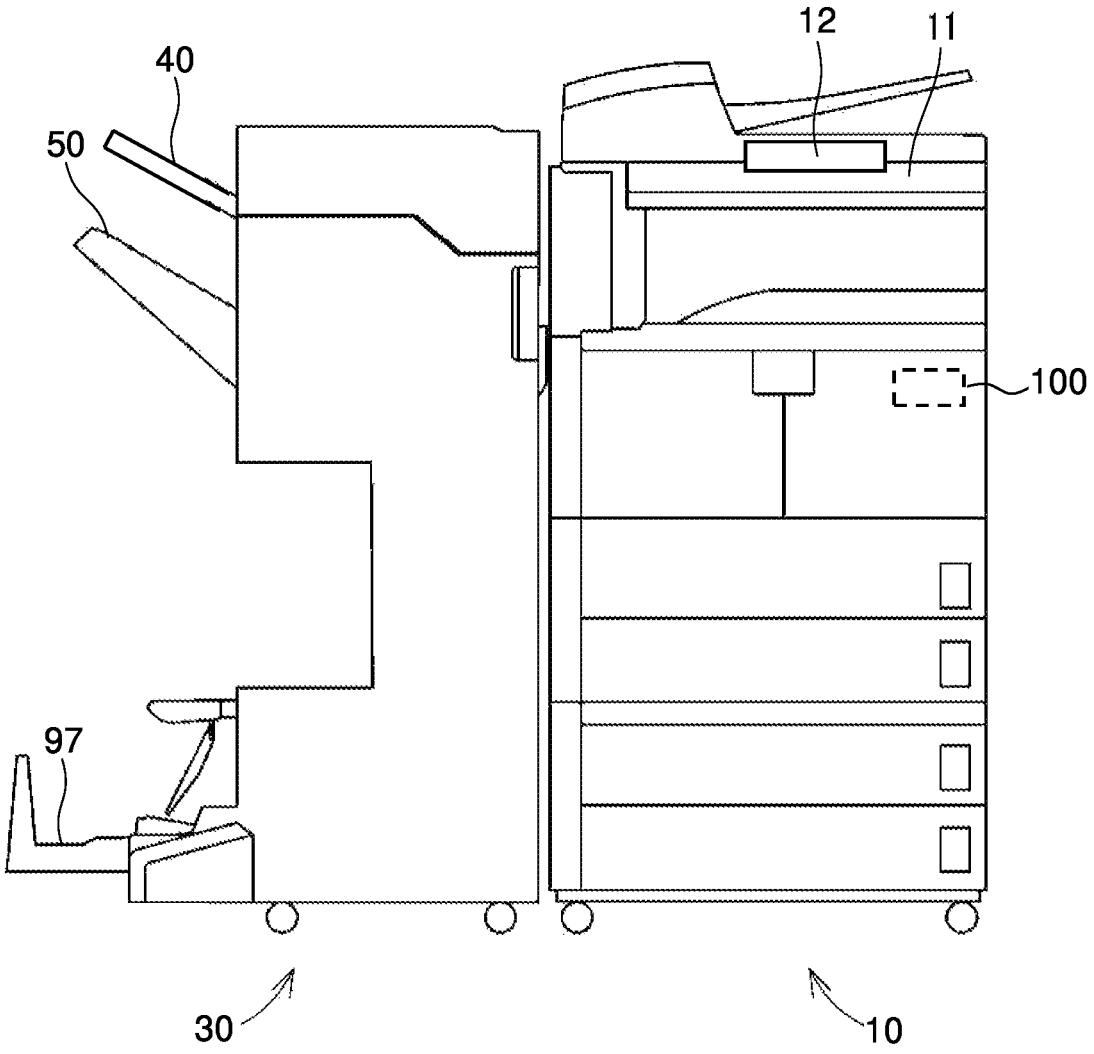
FIG. 1 is an outline diagram showing the configuration of an image forming system comprising a sheet post-processing device according to one embodiment of the present disclosure and an image forming apparatus to which the sheet post-processing device is coupled.
Figure 2:
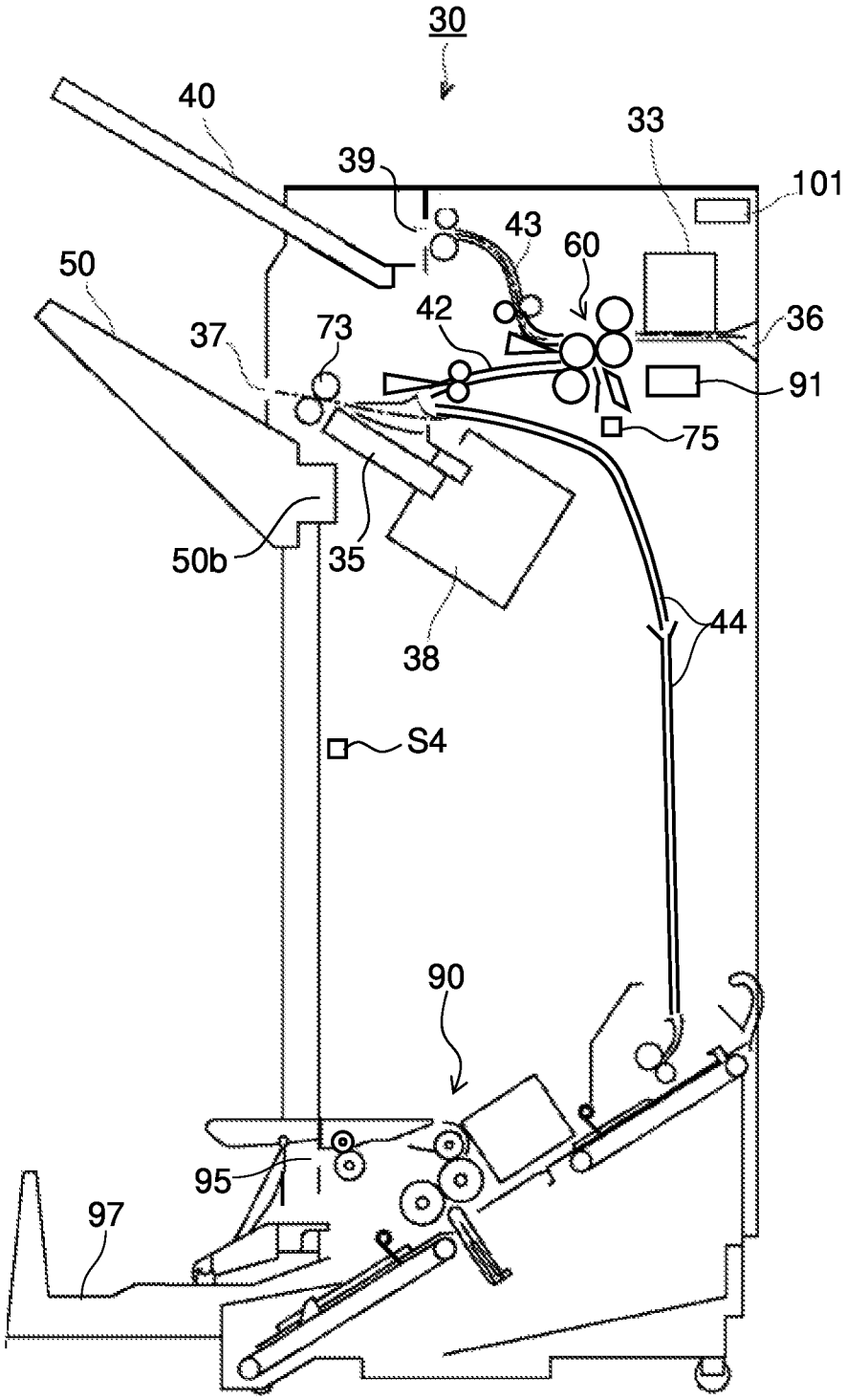
FIG. 2 is a side sectional view showing the internal construction of the sheet post-processing device according to the embodiment.
Figure 3:
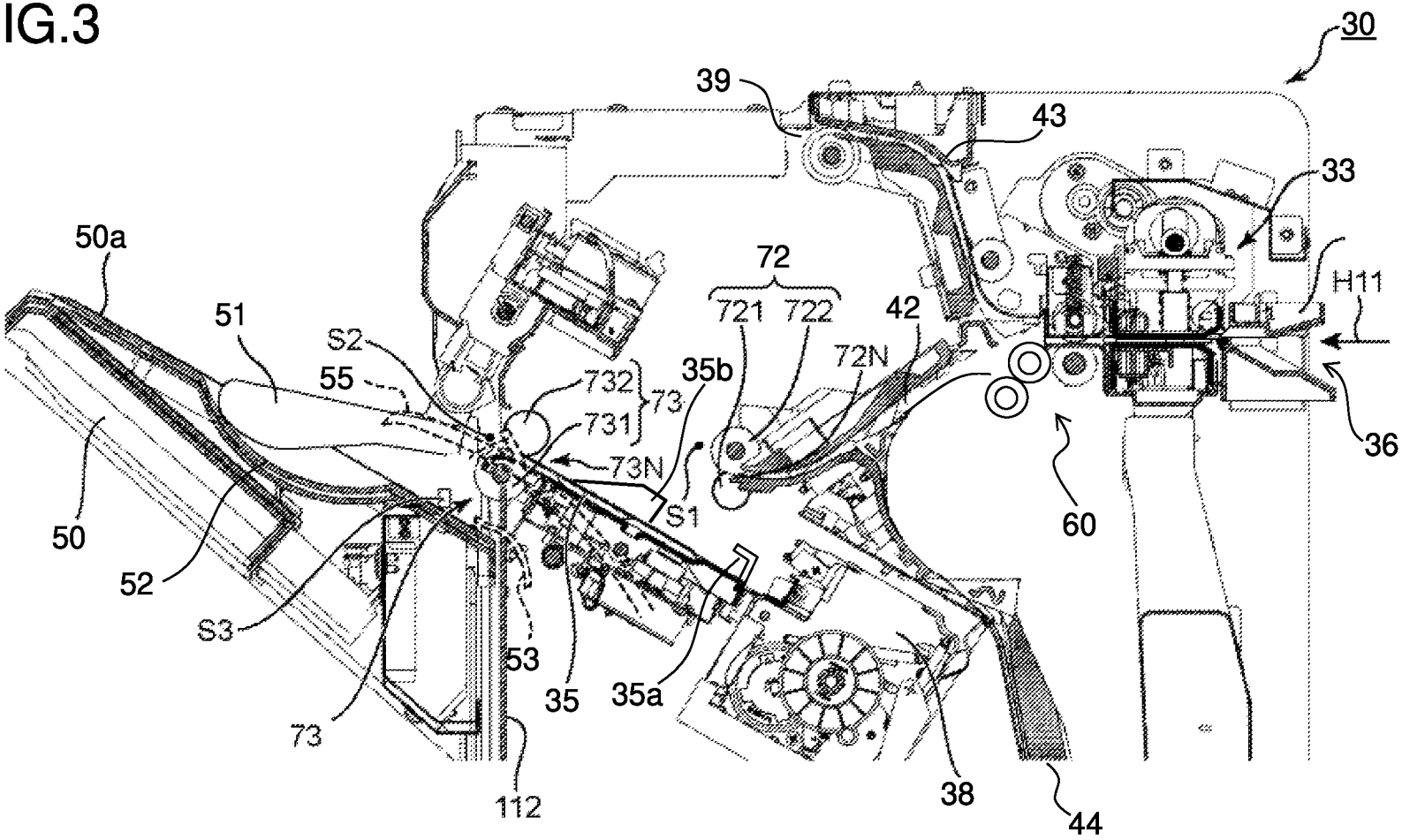

With reference to the accompanying drawings, an embodiment of the present disclosure will be described below. FIG. 1 is an outline diagram showing the configuration of an image forming system comprising a sheet post-processing device 30 according to one embodiment of the present disclosure and an image forming apparatus 10 to which the sheet post-processing device 30 is coupled. FIG. 2 is a side sectional view showing an internal construction of the sheet post-processing device 30 according to the embodiment. FIG. 3 is a part sectional view showing the structure around a processing tray 35 in FIG. 2.

As shown in FIG. 1, the image forming apparatus 10 prints an image on a sheet based on image data fed in from outside via an unillustrated network communication portion or based on image data read by an image reading portion 11 disposed in an upper part of the image forming apparatus 10. The image forming apparatus 10 includes a sheet feed portion that feeds sheets, an image forming portion that forms a toner image on a sheet, a fixing portion that fixes the toner image on the sheet to it, a pair of first discharge rollers and a pair of second discharge rollers that convey the sheets having undergone fixing to discharge them to a discharge portion and to a sheet post-processing device respectively (of which none is illustrated), and a main unit controller 100. The main unit controller 100 controls the operation of the image forming apparatus 10 and, by being configured to be able to communicate with a post-processing controller 101, which will be described later, in a sheet post-processing device 30, also controls the post-processing controller 101.

The sheet post-processing device 30 is used in a state coupled with the image forming apparatus 10, and subjects the sheets conveyed from the image forming apparatus 10 to post-processing such as punch hole formation (perforation), binding, and folding. The sheet post-processing device 30 is not limited to one that performs post-processing on sheets automatically fed in from the image forming apparatus 10 but may be one that conveys sheets set on an unillustrated tray by a user to a position suitable for post-processing and that then performs post-processing on the sheets.

As shown in FIGS. 2 and 3 the sheet post-processing device 30 includes a punch hole forming device 33 that performs predetermined perforation on sheets, a processing tray 35 on which a plurality of sheets are stacked, a stapling unit 38 that binds with staples the bundle of sheets stacked on the processing tray 35, and a first sheet folding unit (folding portion) 60 and a second sheet folding unit 90 that performs folding on sheets.

The sheet post-processing device 30 further includes a sheet introduction port 36 through which a sheet discharged from a discharge portion (not illustrated) of the image forming apparatus 10 is introduced, a main discharge tray 50 (stacking tray) that receives a sheet discharged through a main discharge port 37, a sub discharge tray 40 that receives a sheet discharged through a sub discharge port 39, a post-processing controller 101 that controls the sheet post-processing device 30 in a centralized manner, various switching members, and various rollers.

The sheet introduction port 36 and the main discharge port 37 communicate with each other through a first conveying passage 42. A second conveying passage 43, which is connected to the first conveying passage 42 so as to branch off from it, is connected to the sub discharge port 39. A third conveying passage 44, which is connected to the first conveying passage 42 so as to branch off from it, is connected to the second sheet folding unit 90.

A sheet introduced through the sheet introduction port 36 is fed out downstream (leftward in FIG. 4) along the first conveying passage 42. In the first conveying passage 42, between its upstream and downstream ends in the sheet conveyance direction, a pair of intermediate rollers 72 is disposed. The pair of intermediate rollers 72 comprises a first driving roller 721 that rotates by being fed with a driving force from a conveyance drive portion 70 (see FIG. 8) and a first driven roller 722 that rotates by following the first driving roller 721. The first driving roller 721 and the first driven roller 722 are kept in pressed contact with each other under a predetermined nip pressure to form a conveyance nip 72N that nips a sheet to convey it.

Closely downstream of the pair of intermediate rollers 72, a first sheet sensing portion S1 is disposed. The first sheet sensing portion S1 is a sensor that optically senses a sheet, and senses the leading end of a sheet conveyed along the first conveying passage 42 having entered the pair of intermediate rollers 72. The first sheet sensing portion S1 also senses the trailing end of a sheet conveyed by the pair of intermediate rollers 72 having passed across the pair of intermediate rollers 72.

At the downstream end of the first conveying passage 42, a pair of discharge rollers 73 (discharge portion) is provided that feeds out a sheet to the main discharge tray 50. The pair of discharge rollers 73 comprises a second driving roller 731 that rotates by being fed with a driving force from a discharge drive portion 90 (see FIG. 8) and a second driven roller 732 that rotates by following the second driving roller 731. The second driving roller 731 and the second driven roller 732 are kept in pressed contact with each other under a predetermined nip pressure to form a discharge nip 73N that nips a sheet to convey it. When a sheet is pulled onto the processing tray 35 for stapling by the stapling unit 38, the pair of discharge rollers 73 move apart to release the discharge nip 73N.

Closely downstream of the pair of discharge rollers 73, a second sheet sensing portion S2 is disposed. The sheet sensing portion S2 is composed of (though none is illustrated) an actuator having a contact segment with which a sheet discharged by the pair of discharge rollers 73 makes contact and a sensing segment, and a photosensor having a light-emitting portion and a light-receiving portion that are disposed opposite each other with the sensing segment in between. When the leading end of a sheet conveyed by the pair of intermediate rollers 72 makes contact with the contact segment, the actuator pivots clockwise, and the sensing segment is located out of the optical path from the light-emitting portion to the light-receiving portion. This permits the leading end of the sheet to be sensed to have entered the pair of discharge rollers 73 and to be being discharged by the pair of discharge rollers 73. On the other hand, when the trailing end of a sheet passes across the contact segment, the actuator pivots counter-clockwise, and the sensing segment is located in the optical path from the light-emitting portion to the light-receiving portion. This permits the trailing end of the sheet to be sensed to have passed across the pair of discharge rollers 73.

Below the first conveying passage 42, the processing tray 35 is disposed. With the discharge nip 73N in the pair of discharge rollers 73 released, the processing tray 35 receives and stacks sheets conveyed by the pair of intermediate rollers 72. The bundle of sheets stacked on the processing tray 35 is subjected to stapling by the stapling unit 38. The processing tray 35 has its downstream end (left end in FIG. 3) in the sheet conveyance direction located near the pair of discharge rollers 73, and has its upstream end (right end in FIG. 3) located under the pair of intermediate rollers 72. The processing tray 35 is inclined with a downward slope from its downstream to upstream end in the sheet conveyance direction.

The bundle of sheets stacked on the processing tray 35 and having undergone the stapling by the stapling unit 38 is discharged by the pair of discharge rollers 73 having the discharge nip 73N restored, or by a bundle discharge member 35*a* that reciprocates along the sheet stacking surface of the processing tray 35, onto the main discharge tray 50.

The main discharge tray 50 is provided on a side face (left side face in FIG. 2) of the sheet post-processing device 30 so as to be movable vertically. The main discharge tray 50 chiefly receives sheets having undergone folding in the first sheet folding unit 60 and a bundle of sheets having undergone binding by the stapling unit 38.

Over the main discharge tray 50, a top surface sensor S3 is disposed that senses the position of the top surface of the sheets stacked on the stacking surface 50*a* of the main discharge tray 50. The top surface sensor S3 is a photointerruptor sensor (PI sensor) having a sensing portion composed of a light-emitting portion and a light-receiving portion disposed respectively at one and the other sides in the sheet width direction. The top surface sensor S3 can sense the position of the top surface of sheets when the optical path of the sensing portion is intercepted by the sheets stacked on the stacking surface 50*a*.

Under the main discharge tray 50, a lower limit sensor S4 (see FIG. 2) is disposed that senses the lower limit position of the main discharge tray 50. The lower limit sensor S4 is a PI sensor like the top surface sensor S3. The lower limit sensor S4 can sense the main discharge tray 50 having lowered to its lower limit position when the optical path in the sensing portion is intercepted by a flag 50*b* provided on the main discharge tray 50 so as to project from it.

Upstream of the main discharge tray 50 with respect to the sheet discharge direction, a pair of alignment members 51 is provided. The pair of alignment members 51 is movable in the sheet width direction and in the vertical direction. The pair of alignment members 51 aligns the sheets stacked on the stacking surface 50*a* of the main discharge tray 50 by abutting the opposite side edges of the sheets in their width direction.

Specifically, in the stacking surface 50*a* of the main discharge tray 50, at the opposite sides in the sheet width direction, grooves 52 are provided in which lower end parts of the alignment members 51 can rest. The alignment members 51, with their lower end parts resting in the grooves 52 (sunk below the stacking surface 50*a*), move in the sheet width direction to align sheets.

Figure 4:
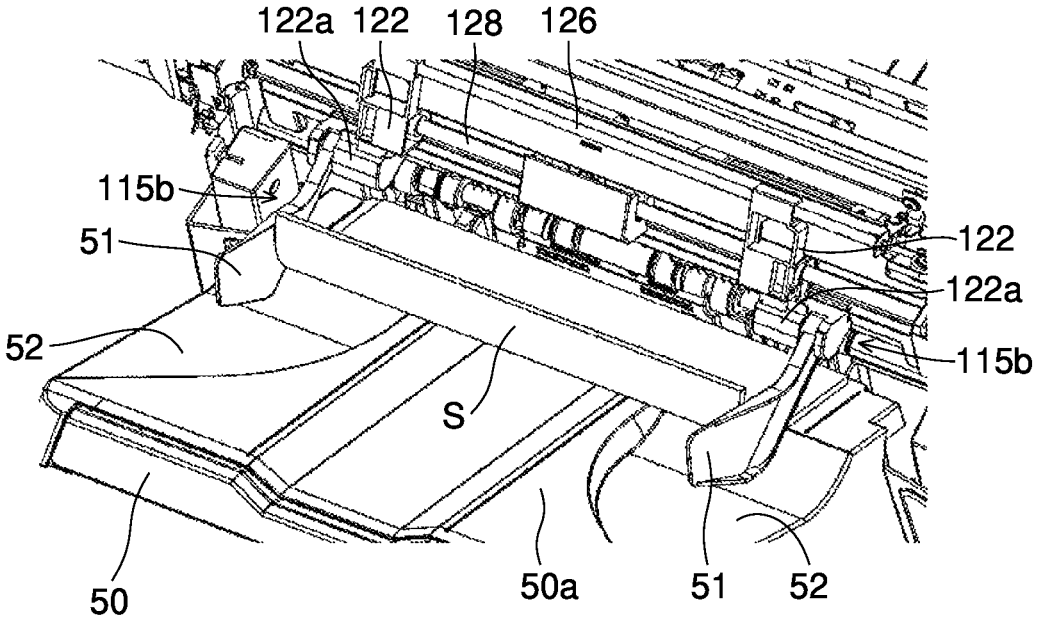
FIG. 4 is a perspective view showing the structure around alignment members in the sheet post-processing device.
Figure 5:
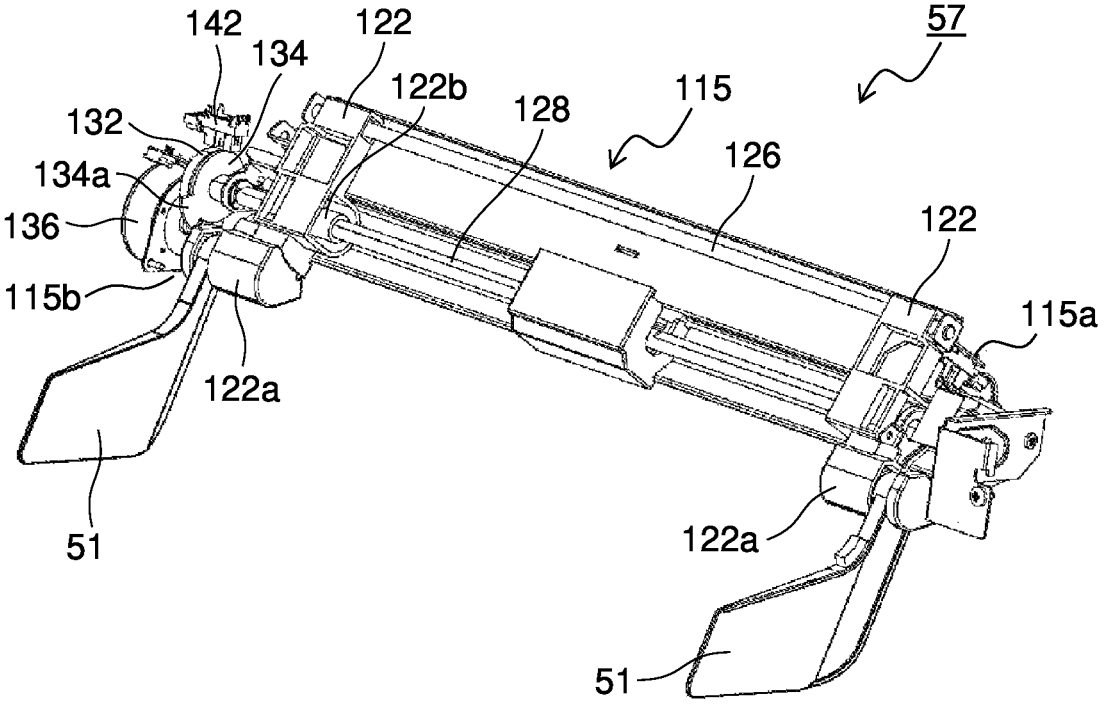
FIG. 5 is a perspective view showing the structure of an alignment mechanism in the sheet post-processing device.

FIG. 4 is a perspective view showing the structure around the alignment members 51 in the sheet post-processing device 30. FIG. 5 is a perspective view showing the structure of an alignment mechanism 57, which includes the alignment members 51 and an alignment drive portion 115 for driving the alignment members 51. As shown in FIGS. 4 and 5, the alignment drive portion 115 includes a width-direction movement mechanism 115*a* for moving the alignment members 51 in the sheet width direction, a vertical movement mechanism 115*b* for moving the alignment members 51 in the vertical direction, a light-shielding member 134 an angle sensor 142, which will both be described later, and the like.

As shown in FIG. 4, the alignment members 51 are held on holding portions 122*a* provided on a lower part of a carriage 122. As shown in FIG. 5, inside the holding portions 122*a*, pivot shafts (not illustrated) are provided, and the alignment members 51 are rotatably supported on the pivot shafts. Moreover, on the alignment members 51, gear portions (not illustrated) that are rotatably supported on the pivot shafts are formed integrally.

By the action of the width-direction movement mechanism 115*a*, the carriage 122 moves in the sheet width direction along a guide shaft 126 and a drive shaft 128 that extend in the sheet width direction. The width-direction movement mechanism 115*a* can be composed of, for example, an endless moving belt on which the carriage 122 is fitted and that extends in the sheet width direction, pulleys on which the moving belt is stretched, a drive motor that drives the pulleys to rotate, and the like. It may instead be composed of a rack that extends in the sheet width direction, a pinion that is provided on the carriage 122 and that engages with the rack, a drive motor that drives the pinion to rotate, and the like.

As shown in FIG. 5, to one end (left end in FIG. 5) of the drive shaft 128, an input gear 132 and a light-shielding member 134 are fastened. The input gear 132 is connected to a pulse motor 136 via a one-way member (not illustrated), such as a one-way gear, that transmits rotation only in one direction. Near one end of the drive shaft 128, an angle sensor 142 is provided that comprises a PI sensor having a light-emitting portion and a light-receiving portion. The angle sensor 142 senses the optical path being free or intercepted by a light-shielding segment 134*a* of the light-shielding member 134, and transmits the sensing result to the post-processing controller 101.

The drive shaft 128 is formed to have a D-shaped cross section. The carriage 122 has a bearing portion 122*b* in which the drive shaft 128 is inserted. The bearing portion 122*b* is formed to have a circular shape as seen in a cross-sectional view. Thus the drive shaft 128 rotates freely with respect to the bearing portion 122*b*.

Inside the carriage 122 are accommodated (though neither is illustrated) a gear that is slidable in the axial direction with respect to the drive shaft 128 and that rotates together with the drive shaft 128, and a middle gear that transmits the rotation of the gear to the gear portions of the alignment members 51. The carriage 122, the drive shaft 128, the pulse motor 136, the one-way member (not illustrated) together constitute the vertical movement mechanism 115*b*.

As the pulse motor 136 (see FIG. 5) rotates forward, the alignment members 51 rotate forward (upward in FIG. 5) about the drive shaft 128, so that tip end parts of the alignment members 51 are raised. Meanwhile, the light-shielding segment 134*a* of the light-shielding member 134 frees the optical path of the angle sensor 142 and then the pulse motor 136, after further rotating for a predetermined number of pulses, stops so that the alignment members 51 retract from over the main discharge tray 50 and are located at a retracted position inside the sheet post-processing device 30.

From this state, as the pulse motor 136 rotates reversely, the alignment members 51 rotate reversely (downward in FIG. 5) under their own weight so that the tip end parts of the alignment members 51 move down. Meanwhile, if the alignment members 51 are located at a position where they do not make contact with the sheets S on the main discharge tray 50 (at a position outside the sheet stacking area in the sheet width direction), the lower end parts of the alignment members 51 rest in the grooves 52, and the alignment members 51 are located at an aligning position (the position in FIGS. 3 and 4) where they can align the sheets S.

Referring back to FIG. 3, upstream of the main discharge tray 50 with respect to the sheet discharge direction, a sheet pressing member 53 is disposed. The sheet pressing member 53 is disposed below the rotary shaft 731*a* of the second driving roller 731 in the pair of discharge rollers 73.

The sheet pressing member 53 is positioned, by a sheet presser driving portion 116 (see FIG. 8), selectively either at a pressing position, where it presses an upstream part of the sheets stacked on the main discharge tray 50, or at a retracted position, where it is free from pressing the sheets.

Under the processing tray 35, projecting members 55 are disposed. More specifically, the projecting members 55 are disposed under the processing tray 35, below the discharge trajectory of a sheet discharged along the processing tray 35 from a pair of discharge rollers 73. The projecting members 55 are each a member in the shape of a bar that has a predetermined width in the sheet width direction and that extends in the shape of a circular arc in the sheet discharge direction. The projecting members 55 are disposed in a pair along the sheet width direction, at predetermined distances from the middle of the main discharge tray 50 in the sheet width direction. The projecting members 55 support the bottom surface of sheets discharged from the processing tray 35 onto the main discharge tray 50 to suppress curling and reversing of the sheets.

At the downstream end of the second conveying passage 43, the sub discharge port 39 through which sheets are is fed out to the sub discharge tray 40 is provided. The sub discharge tray 40 chiefly receives sheets that are discharged without being subjected to post-processing by the sheet post-processing device 30 and sheets that are subjected only to perforation by the punch hole forming device 33.

The punch hole forming device 33 is disposed between the sheet introduction port 36 and the first sheet folding unit 60, so as to face the first conveying passage 42 from above. The punch hole forming device 33 performs perforation with predetermined timing on the sheets conveyed along the first conveying passage 42.

The stapling unit 38 is disposed downstream of the first conveying passage 42, under it. The stapling unit 38 performs binding whereby it binds with staples a plurality of sheets introduced onto the processing tray 35.

The first sheet folding unit 60 is disposed closely upstream of the branch portion between the first and second conveying passages 42 and 43. The first sheet folding unit 60 performs folding on a sheet, for example, when a user selects folding on a single sheet. The structure of the first sheet folding unit 60 will be described in detail later.

The second sheet folding unit 90 is disposed under the sheet post-processing device 30, downstream of the third conveying passage 44. The second sheet folding unit 90 performs folding on sheets, for example, when a user selects folding on a plurality of sheets. Downstream of the second sheet folding unit 90, there are provided a lower discharge port 95 for discharging a bundle of sheets having undergone folding by the second sheet folding unit 90 and a lower discharge tray 97 for receiving the bundle of sheets discharged through the lower discharge port 95.

Figure 6A:
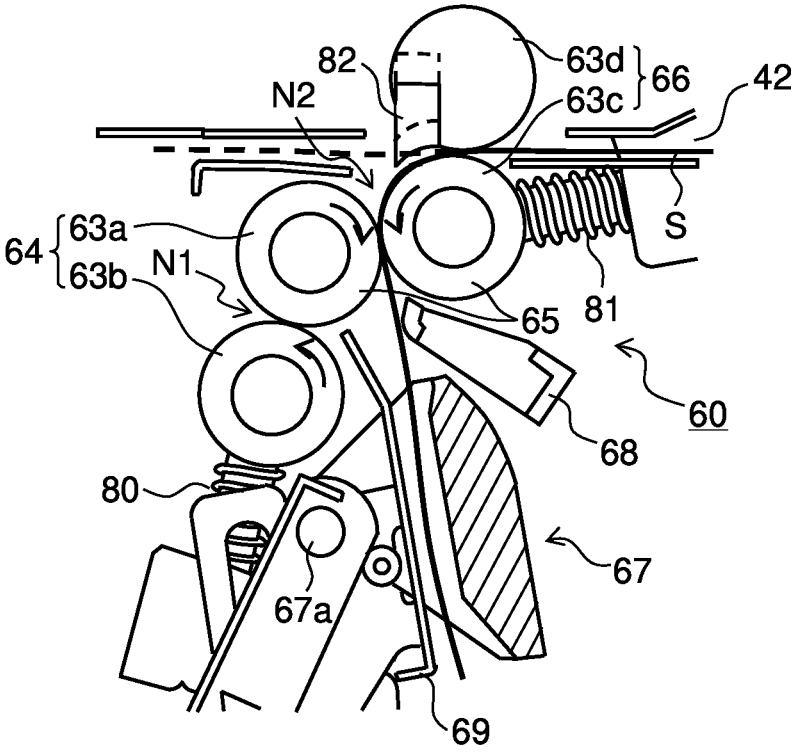
FIG. 6A is a sectional view showing the structure around a first sheet folding unit in in the sheet post-processing device according to the embodiment, showing a state immediately before a sheet is folded in two.
Figure 6B:
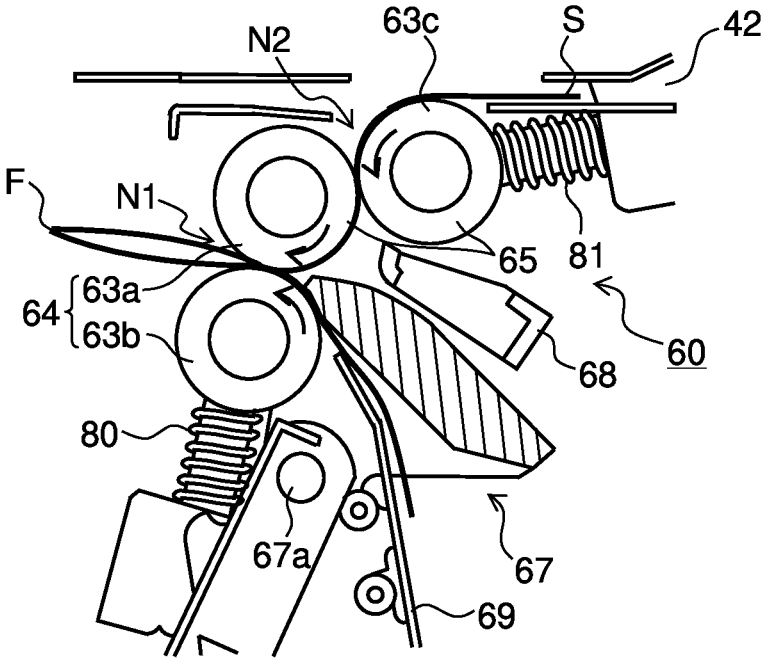
FIG. 6B is a sectional view showing the structure around the first sheet folding unit in the sheet post-processing device according to the embodiment, showing how a sheet is folded in two by a folding blade.

FIGS. 6A and 6B are part enlarged views around the first sheet folding unit 60 in FIG. 3. Now the structure of the first sheet folding unit 60 will be described in detail. As shown in FIG. 6A, the first sheet folding unit 60 includes a pair of folding rollers 64, a pair of first conveyance rollers 65, a folding blade 67, a fixed guide 68, and a movable guide 69.

The pair of folding rollers 64 is composed of a first roller 63*a* and a second roller 63*b*. The second roller 63*b* is kept in pressed contact with the first roller 63*a* under a predetermined pressure by a first pressing mechanism 80 to form a first nip N1. A sheet S that has passed through the first nip N1 is conveyed from right to left in FIG. 6A.

The pair of first conveyance rollers 65 is composed of the first roller 63*a* and a third roller 63*c*. The third roller 63*c* is kept in pressed contact with the first roller 63*a* under a predetermined pressure by a second pressing mechanism 81 to form a second nip N2. A sheet S that has passed through the second nip N2 is conveyed from top to bottom in FIG. 6A.

The third roller 63*c* has a fourth roller 63*d* kept in pressed contact with it so that these together constitute a pair of second conveyance rollers 66. The fourth roller 63*d* is composed of two rollers apart from each other in the axial direction (direction perpendicular to the plane of FIG. 6A), which are kept in pressed contact with opposite end parts, respectively, of the third roller 63*c* in the axial direction. Between the two rollers of the fourth roller 63*d*, a switch guide 82 is disposed. When a sheet S is not subjected to folding, the switch guide 82 is retracted upward (to the position indicated by a broken line) so that the sheet S is conveyed horizontally along the first conveying passage 42 and is discharged onto the main discharge tray 50 (see FIG. 2). Or the sheet S passes through the second conveying passage 43 branching off from the first conveying passage 42 and is discharged onto the sub discharge tray 40 (see FIG. 2).

The folding blade 67 is disposed at the opposite side (right side in FIG. 6A) of the conveyance passage for sheets S from the pair of folding rollers 64. The folding blade 67 is swingably supported on a pivot shaft 67*a*. The folding blade 67 is positioned selectively either at a folding position (see FIG. 6B) where it performs folding by pushing a sheet S into the first nip N1 or at a retracted position (see FIG. 6A) where it is retracted away from the folding position.

The fixed guide 68 and the movable guide 69 are arranged upstream of the pair of folding rollers 64 with respect to the sheet conveyance direction, and guide a sheet S that has passed through the second nip N2. The fixed guide 68 is fixed between a conveyance roller 63 and the folding blade 67. The movable guide 69 is positioned selectively either at a covering position (see FIG. 6A) at which it covers the outer circumferential surface of the second roller 63*b* in the pair of folding rollers 64 or at a released position (see FIG. 6B) at which it exposes the outer circumferential surface of the second roller 63*b*.

Figure 7A:
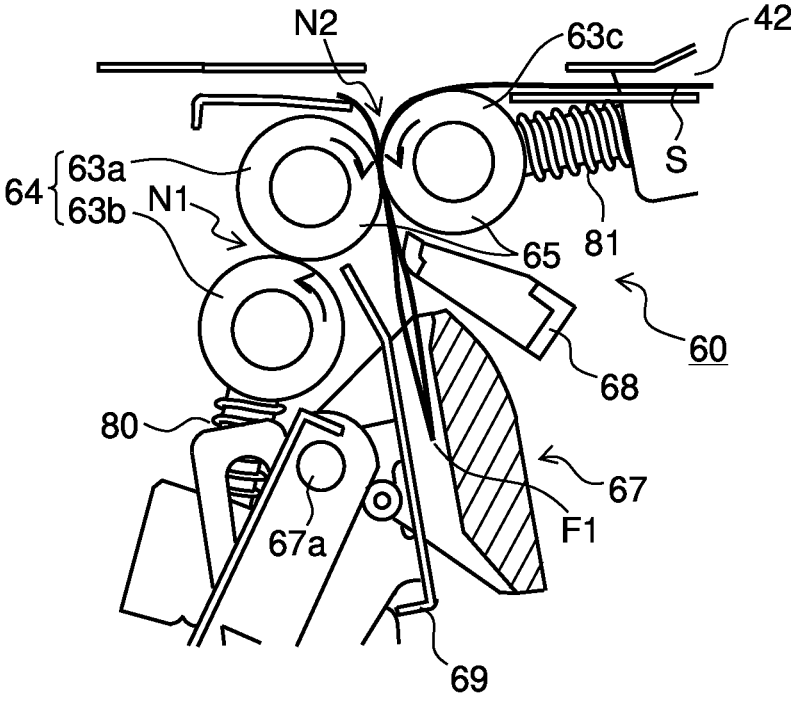
FIG. 7A is a sectional view showing the structure around the first sheet folding unit in the sheet post-processing device according to the embodiment, showing a state immediately before a sheet is folded in three by the first sheet folding unit.
Figure 7B:
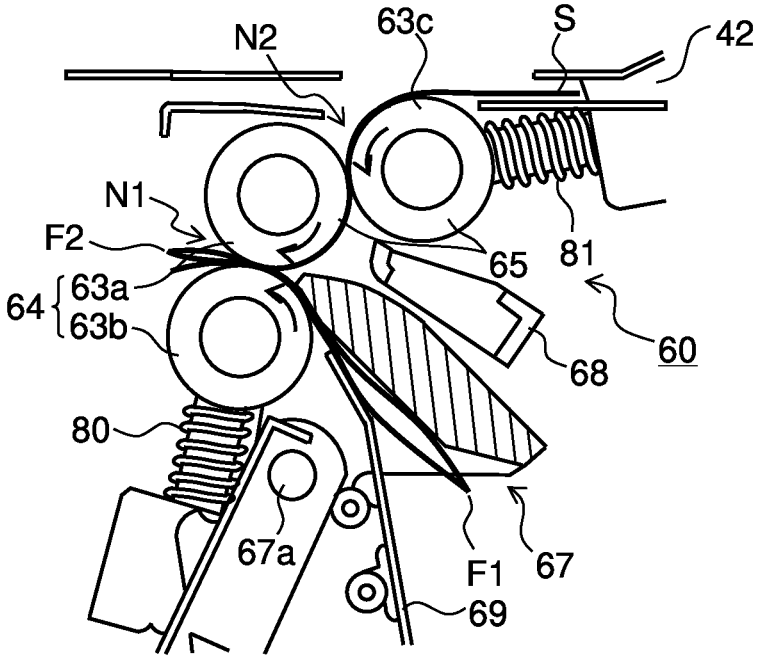
FIG. 7B is a sectional view showing the structure around the first sheet folding unit in the sheet post-processing device according to the embodiment, showing how a sheet is folded in three by the folding blade.

Next, with reference to FIGS. 6A, 6B, 7A, and 7B, the folding of a sheet S by the first sheet folding unit 60 will be described. The folding of a sheet S is performed by the post-processing controller 101 (see FIG. 2) provided in the sheet post-processing device 30 when a user selects a folding mode using an operation panel 12 (see FIG. 2) on the image forming apparatus 10. In FIGS. 6B, 7A, and 7B, the fourth roller 63*d* and the switch guide 82 are omitted from illustration.

First, a description will be given of how a sheet S is folded in two. As shown in FIG. 6A, for a sheet S introduced from the first conveying passage 42, the switch guide 82 switches the conveying direction to downward. Thus the sheet S is conveyed along the outer circumferential surface of the third roller 63*c* and passes through the second nip N2 in the pair of first conveyance rollers 65. Then the conveyance of the sheet S is suspended such that a part (middle part in the sheet conveyance direction) of the sheet S at which it is to be folded is located opposite the first nip N1.

The timing with which to suspend the conveyance of the sheet S is determined based on the timing of sensing by a sheet sensor 75 (see FIG. 2). Specifically, when the sheet sensor 75 senses the leading end of a sheet S, the sensing result is transmitted to the post-processing controller 101. By controlling a conveyance driving portion 110 (see FIG. 8) the post-processing controller 101 suspends the conveyance of the sheet S at the lapse of a predetermined time after the sensing of the leading end of the sheet S. The time after the sensing of the leading end of the sheet S until the suspension of the conveyance of the sheet S is predetermined for each of different sizes of sheets S.

Next, as shown in FIG. 6B, the movable guide 69 is moved to the released position and the folding blade 67 is swung counter-clockwise to be moved to the folding position. Now the folding blade 67 makes contact with the to-be-folded part of the sheet S. The sheet S pushed forth by the folding blade 67 is, in a curved state, pushed into the first nip N1 in the pair of folding rollers 64. The sheet S having passed through the first nip N1 has a fold line F formed in it.

The sheet S having the fold line F formed in it passes through the first conveying passage 42 and is discharged through the main discharge port 37 (pair of discharge rollers 73) onto the main discharge tray 50. Then the movable guide 69 is moved to the covering position and the folding blade 67 is moved to the retracted position, thus back to the state in FIG. 6A. Thereafter, sheets S are subjected to double folding likewise.

Next, a description will be given of how a sheet S is folded in three (in a Z shape). In triple folding, first the switch guide 82 (see FIG. 6A) is retracted up, and the leading end of a sheet S conveyed through the first conveying passage 42 is stopped downstream of (at the left of) the second nip N2 such that a part of the sheet S (at one third of the length of the sheet S from the leading end) at which it is to be folded first is located opposite the second nip N2. The timing with which to suspend the conveyance of the sheet S is determined based on the timing of sensing by a sheet sensor (not illustrated) disposed in the first conveying passage 42.

Next, the switch guide 82 is moved down. Now the switch guide 82 makes contact with the to-be-folded-first part of the sheet S. There the sheet S is pushed forth by the switch guide 82 and is, in a curved state, pushed into the second nip N2 in the pair of first conveyance rollers 65 as shown in FIG. 7A. The sheet S having passed through the second nip N2 has a fold line F1 formed in it. The pair of first conveyance rollers 65 functions as a pair of folding rollers in triple folding.

Then the sheet S passes, starting with the fold line F1, through the second nip N2 and then passes between the fixed guide 68 and the movable guide 69. Then the conveyance of the sheet S is suspended such that a part of the sheet S (two thirds of the length of the sheet S from the leading end) at which it is to be folded next is located opposite the first nip N1. The timing with which to suspend the conveyance of the sheet S is determined based on the timing of sensing by the sheet sensor 75.

Next, as shown in FIG. 7B, the movable guide 69 is moved to the released position and the folding blade 67 is swung counter-clockwise to be moved to the folding position. Now the folding blade 67 makes contact with the to-be-folded-next part of the sheet S. The sheet S is pushed forward by the folding blade 67 so that both the leading end and the curled part of the sheet S are pushed into the first nip N1 in the pair of folding rollers 64. The sheet S having passed through the first nip N1 has a fold line F2 formed in it.

The sheet S having the fold lines F1 and F2 formed in it passes through the first conveying passage 42 to be discharged through the main discharge port 37 (pair of discharge rollers 73) onto the main discharge tray 50. Then the movable guide 69 is moved to the covering position, the folding blade 67 is moved to the retracted position, and the switch guide 82 is retracted up. Thereafter, sheets S are subjected to triple folding likewise.

Figure 8:
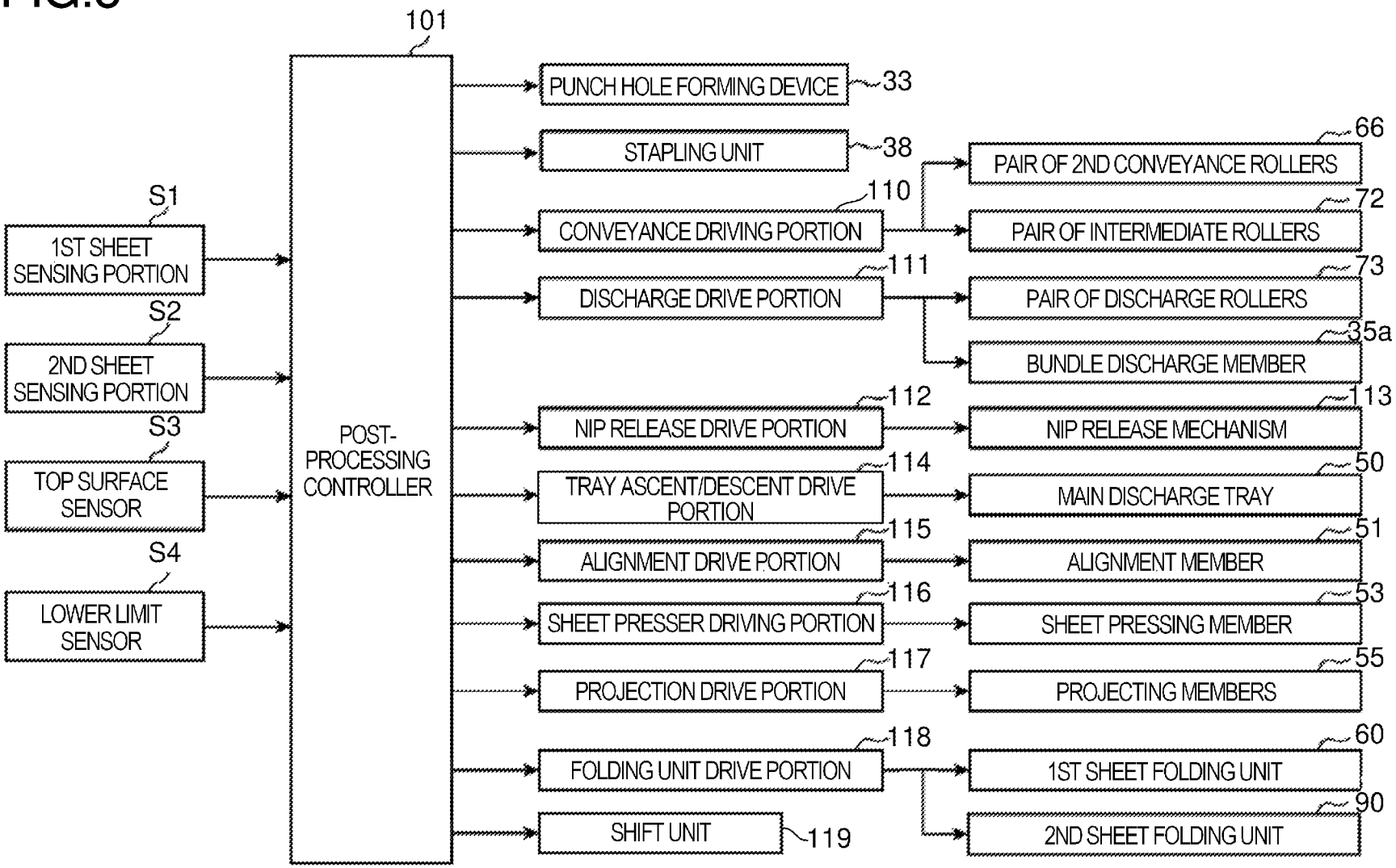
FIG. 8 is a block diagram showing one example of control paths in the sheet post-processing device according to the embodiment.

FIG. 8 is a block diagram showing one example of the control paths in the sheet post-processing device 30. The post-processing controller 101 (hereinafter referred to simply as controller 101) includes a CPU (central processing unit) that controls the operation of different parts in the sheet post-processing device 30, a ROM (read-only memory) that stores control programs, a RAM (random-access memory) that is used as a working area for the CPU, and the like. With the CPU executing the control programs stored in the ROM, the controller 101 controls the operation of different parts in the sheet post-processing device 30.

The controller 101 controls the perforation operation by the punch hole forming device 33 and the stapling operation by the stapling unit 38. The controller 101 controls the driving by the conveyance driving portion 110 to control the starting and stopping of the rotation of the pair of second conveyance rollers 66 and the pair of intermediate rollers 72. The controller 101 controls the driving by a discharge drive portion 111 to control the starting and stopping of the rotation of the pair of discharge rollers 73.

The controller 101 controls the driving by a nip release drive portion 112 to control the releasing and restoring of the discharge nip 73N in the pair of discharge rollers 73 by a nip release mechanism 113. For example, when stapling by the stapling unit 38 is performed on a bundle of sheets containing a predetermined number of sheets, after the first sheet is pulled onto the processing tray 35, the controller 101, by making the nip release drive portion 112 operate the nip release mechanism 113, releases the discharge nip 73N. After the second and subsequent sheets are pulled onto the processing tray 35 and stapling is performed, when the bundle of sheets is discharged onto the main discharge tray 50, the controller 101 restores the discharge nip 73N.

When a bundle of sheets is discharge onto the main discharge tray 50 by the bundle discharge member 35*a*, with the discharge nip 73N released, the bundle discharge member 35*a* is moved downstream in the sheet discharge direction, and the bundle of sheets is discharged by being pushed out onto the main discharge tray 50.

The controller 101 controls the driving by a tray ascent/descent drive portion 114 to control the ascending and descending operation of the main discharge tray 50. The controller 101 controls the driving by the alignment drive portion 115 to perform the alignment of sheets by the alignment members 51. The controller 100 controls the driving of the sheet presser driving portion 116 to control the swinging operation of the sheet pressing members 53 between the pressing position and the retracted position. The controller 101 controls the driving by a projection drive portion 117 to control the movement of the projecting member 55 between the projecting position and the retracted position. The controller 101 controls the driving by a folding unit drive portion 118 to control the sheet folding operation by the first and second sheet folding units 60 and 90.

The controller 101 drives a shift unit 119 to perform, when a plurality of copies of a bundle of sheets S are discharged, sorting (shifting) of bundle of sheets by shifting for each copy the discharge position of the bundle of sheets S alternately to one and the other side in the sheet width direction. The shift unit 119 includes a pair of cursors 35*b* that shifts a bundle of sheets stacked on the processing tray 35 in the sheet width direction and a cursor drive portion (not illustrated) that makes the cursors reciprocate.

In a mode where sheets S are stacked one after another continuously on the main discharge tray 50, the top surface sensor S3 senses the position of the top surface of the bundle of sheets stacked on the main discharge tray 50. The ascent and descent (positioning) of the main discharge tray 50 is performed such that the top surface of the bundle of sheets remains at a fixed position. For the aligning of the stacked bundle of sheets in the front-back direction (sheet width direction), it is achieved by moving the alignment members 51 in the vertical and width directions.

When double-folded or triple-folded (Z-folded) sheets S are stacked on the main discharge tray 50, in a downstream part of the sheets S in the sheet discharge direction, a bulge may form that is higher than the top surface position sensed by the top surface sensor S3.

If in this state the sheets S are subjected to sorting (shifting), as the sorting position is switched, when the alignment members 51 in a raised state are moved in the width direction to move the alignment position, the alignment members 51 may be caught on the bulge and push sheets S out. In particular, triple-folded (Z-folded) sheets tend to form a large bump and are more prone to this inconvenience.

To prevent that, in this embodiment, when sheets S folded in the first sheet folding unit 60 are shorted and then discharged onto the main discharge tray 50, how the alignment members 51 operate is changed so as to suppress irregular stacking of sheets S.

Figure 9:
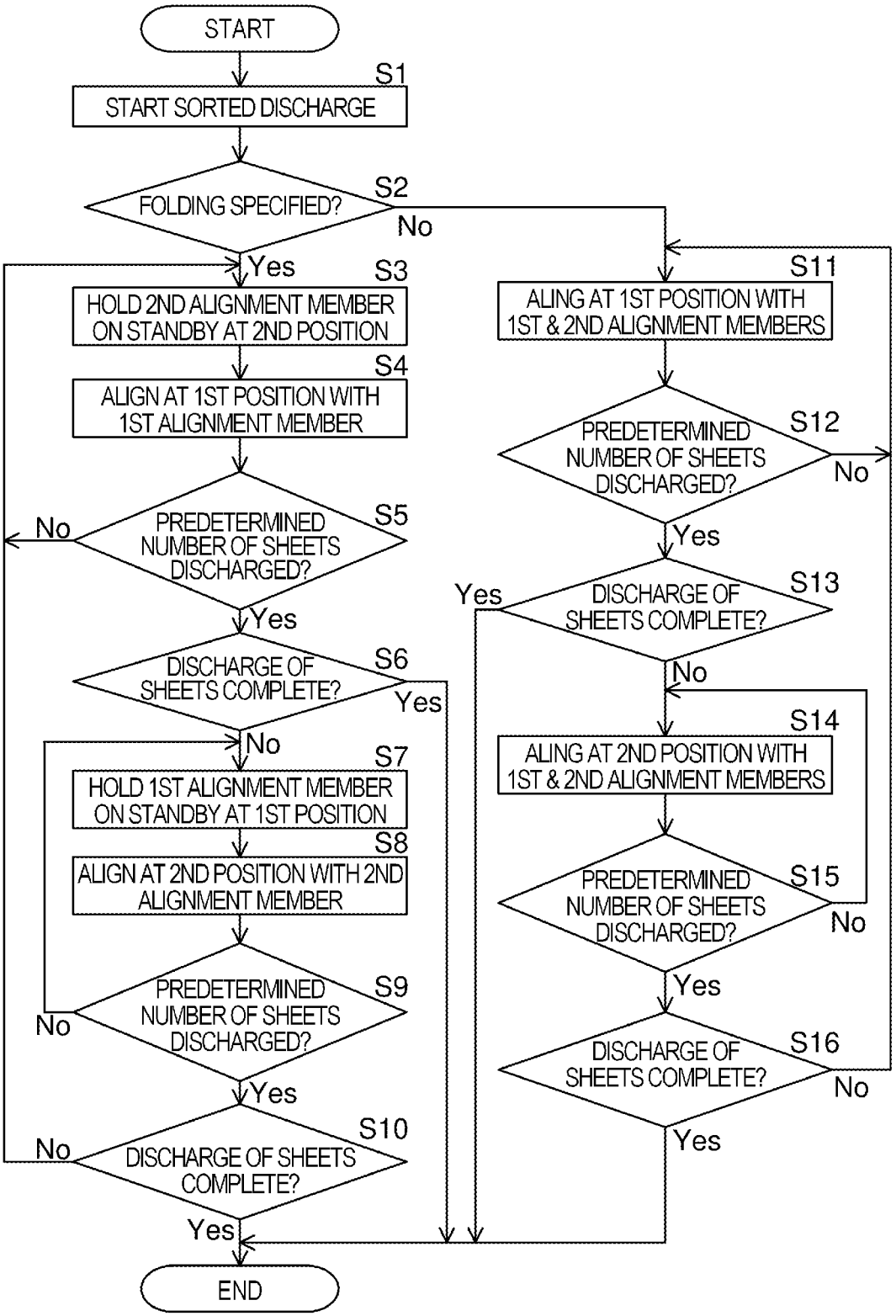
FIG. 9 is a flow chart showing a first example of operation control for the alignment members during sorting on the sheet post-processing device according to the embodiment.

FIG. 9 is a flow chart showing a first example of operation control for the alignment members 51 during sorted discharge on the sheet post-processing device 30 according to this embodiment. With reference to, as necessary, FIGS. 1 to 8 and also FIG. 10, which will be described later, the alignment operation by the alignment members 51 during sorting will be described through the steps in FIG. 9. In the following description, it is assumed that sorting causes sheets to be discharged either at one side in the sheet width direction (at the near side of the apparatus, a first shift position) or at the other side in the sheet width direction (at the far side of the apparatus, a second shift position).

Of the pair of alignment members 51, the one disposed at one side in the sheet width direction (at the near side of the apparatus) will be referred to as the first alignment member 51*a* and the one disposed at the other side (the far side of the apparatus) in the sheet width direction will be referred to as the second alignment member 51*b*. For each of the first and second first alignment members 51*a* and 52*b*, their aligning position (the position at which they make contact with a width-direction edge of sheets S) when sheets S are discharged at one side and at the other side in the sheet width direction will be referred to the first position and the second position respectively.

Figure 10A:
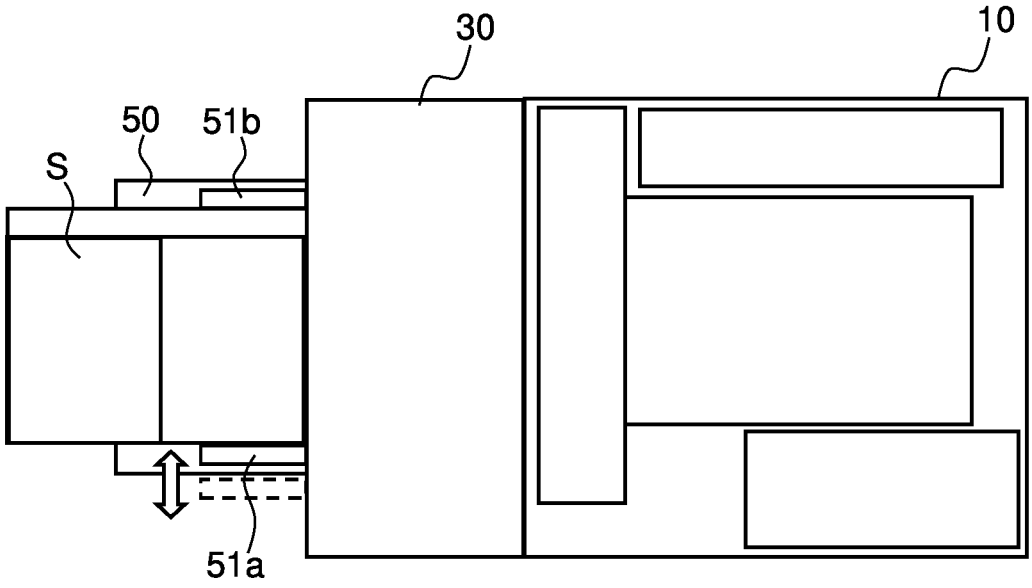
FIG. 10A is a diagram showing how, when sheets are discharged at one side in the sheet width direction (the near side of the apparatus), alignment is performed with the second alignment member held on standby at a second position and only the first alignment member made to reciprocate at a first position in the example of operation control in FIG. 9.

When sorting starts (step S1), the post-processing controller 101 checks whether folding of sheets S by the first sheet folding unit 60 is specified (step S2). If folding is specified (Step S2, "Yes"), then as shown in FIG. 10A, when sheets S are discharged at one side in the sheet width direction (at the near side of the apparatus), the second alignment member 51*b* is held on standby at the second position (step S3). Meanwhile only the first alignment member 51*a* is made to reciprocate between the first position and a position outward of the first position to perform alignment (step S4).

The post-processing controller 101 checks whether a predetermined number of sheets S have been discharged (step S5). If the predetermined number has not been reached (S5, "No"), then back at step S3, the discharge of sheets S at one side in the sheet width direction (at the near side of the apparatus) is continued (steps S3 and S4). If at step S5 the predetermined number of sheets have been discharged (step S5, "Yes"), whether the discharge of sheets S is complete (step S6) is checked. If the discharge of sheets S is complete (step S6, "Yes"), sorted discharge is ended.

Figure 10B:
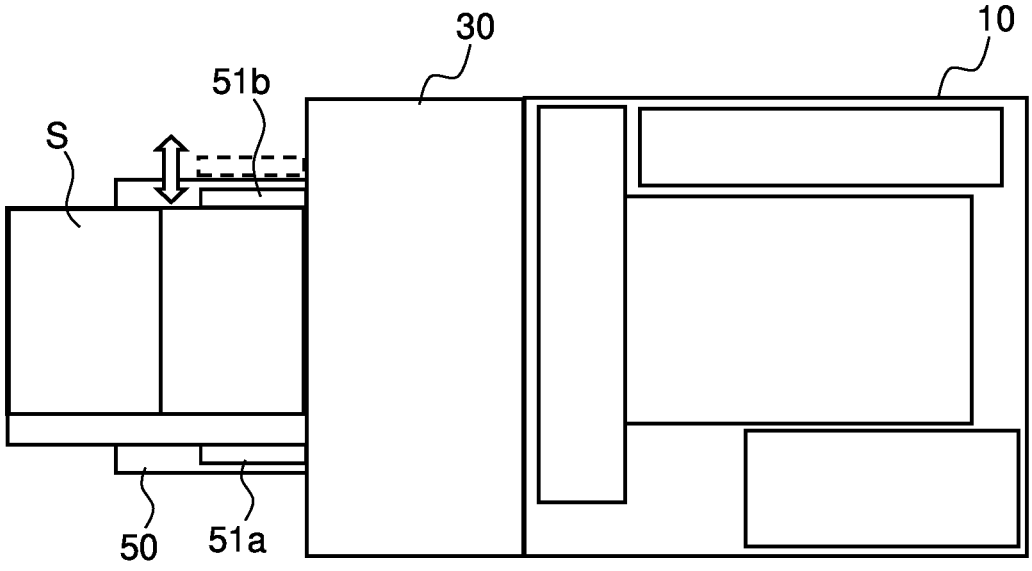
FIG. 10B is a diagram showing how, when sheets are discharged at the other side in the sheet width direction (the far side of the apparatus), alignment is performed with the first alignment member held on standby at a first position and only the second alignment member made to reciprocate at a second position in the example of operation control in FIG. 9.

If at step S6 the discharge of sheets S continues (step S6, "No"), the discharge position is switched from one side in the sheet width direction (the near side of the apparatus) to the other side (the far side of the apparatus). Then, as shown in FIG. 10B, when sheets S are discharged at the other side in the sheet width direction, the first alignment member 51*a* is held on standby at the first position (step S7). Meanwhile only the second alignment member 51*b* is made to reciprocate between the second position and a position outward of the second position to perform alignment (step S8).

The post-processing controller 101 checks whether a predetermined number of sheets S have been discharged (step S9). If the predetermined has not been reached (step S8, "No"), then back at step S7, the discharge of sheets S at the other side in the sheet width direction is continued (steps S7 and S8). If at step S9 the predetermined number of sheets S have been discharged (step S9, "Yes"), the post-processing controller 101 checks whether the discharge of sheets S is complete (step S10).

If at step S10 the discharge of sheets S continues (step S10, "No"), the discharge position is switched from the other side in the sheet width direction back to the one side. Then, back at step S3, sorting is repeated likewise (steps S3 to S10). If the discharge of sheets S is complete (step S10, "Yes"), sorting is ended.

On the other hand, if at step S2 folding is not specified (step S2, "No"), the first alignment member 51*a* is made to reciprocate between the first position and a position outward of the first position and the second alignment member 51*b* is made to reciprocate between the second position and a position outward of the second position to perform alignment (step S11).

The post-processing controller 101 checks whether a predetermined number of sheets S have been discharged (step S12). If the predetermined number of sheets S has not been reached (step S12, "No"), then back at step S11, the discharge of sheets S at one side in the sheet width direction (the near side of the apparatus) is continued. If at step S12 the predetermined number of sheets S have been discharged (step S12, "Yes"), whether or not the discharge of sheets S is complete is checked (step S13). If the discharge of sheets S is complete (step S13, "Yes"), sorting is ended.

If at step S13 the discharge of sheets S continues (step S13, "No"), the discharge position is switched from one side in the sheet width direction to the other side. Then, when sheets S are discharged at the other side in the sheet width direction, the first and second alignment members 51*a* and 51*b* are made to move, respectively, between the first position and a position outward of the first position and between the second position and a position outward of the second position (step S14).

The post-processing controller 101 checks whether the predetermined sheets S have been discharged (step S15). If the predetermined number has not been reached (step S15, "No"), then back at step S14, the discharge of sheets S at the other side in the sheet width direction (at the far side of the apparatus) is continued. If at step S15 the predetermined sheets S have been discharged (step S15, "Yes"), whether or not the discharge of sheets S is complete is checked (step S16).

If at step S16 the discharge of sheets S continues (step S16, "No"), the discharge position is switched from the other side in the sheet width direction back to the one side. Then, back at step S11, sorting is repeated likewise (steps S11 to S16). If the discharge of sheets S is complete (step S16, "Yes"), sorting is ended.

Though omitted from illustration in FIG. 9, if at step S5, S9, S12, or S15 the discharge of all the sheets S is complete before the predetermined number of sheets are discharged, then at that moment sorting is ended. If the sheets S sorted and discharged on the main discharge tray 50 do not include a sheet S having undergone folding, the first and second alignment members 51*a* and 51*b* perform alignment operation in a first alignment mode. On the other hand, if the sheets S sorted and discharged on the main discharge tray 50 include a sheet S having undergone folding, the first or second alignment member 51*a* or 51*b* perform alignment operation (see FIGS. 10A and 10B) in a second alignment mode.

In the first example of operation control shown in FIG. 9, if folding is specified when sorting is performed, the second alignment mode is used, that is, alignment is performed using only the alignment member 51 located outward of the sorting position with respect to the sheet width direction (i.e., the first alignment member 51*a* if the discharge position is at the front side of the apparatus, or the second alignment member 51*b* if it is at the far side of the apparatus) so that, when the discharge position is switched, the alignment member 51 located inward of the sorting position (i.e., the second alignment member 51*b* when the discharge position is switched to the front side of the apparatus, or the first alignment member 51*a* if it is switched to the far side of the apparatus) will not move to over the sheets S already discharged.

Thus, even the sheets S have a bulge resulting from folding, it does not occur that the bulging part of the sheets S is caught on a first alignment member 51 and is pushed out. It is thus possible to suppress irregular stacking of sheets S on the main discharge tray 50.

On the other hand, if folding is not specified, the first alignment mode is used, that is, alignment is performed using both the first and second alignment members 51*a* and 51*b* so that the sheets S discharged at the different sorting positions will be properly aligned.

Figure 11:
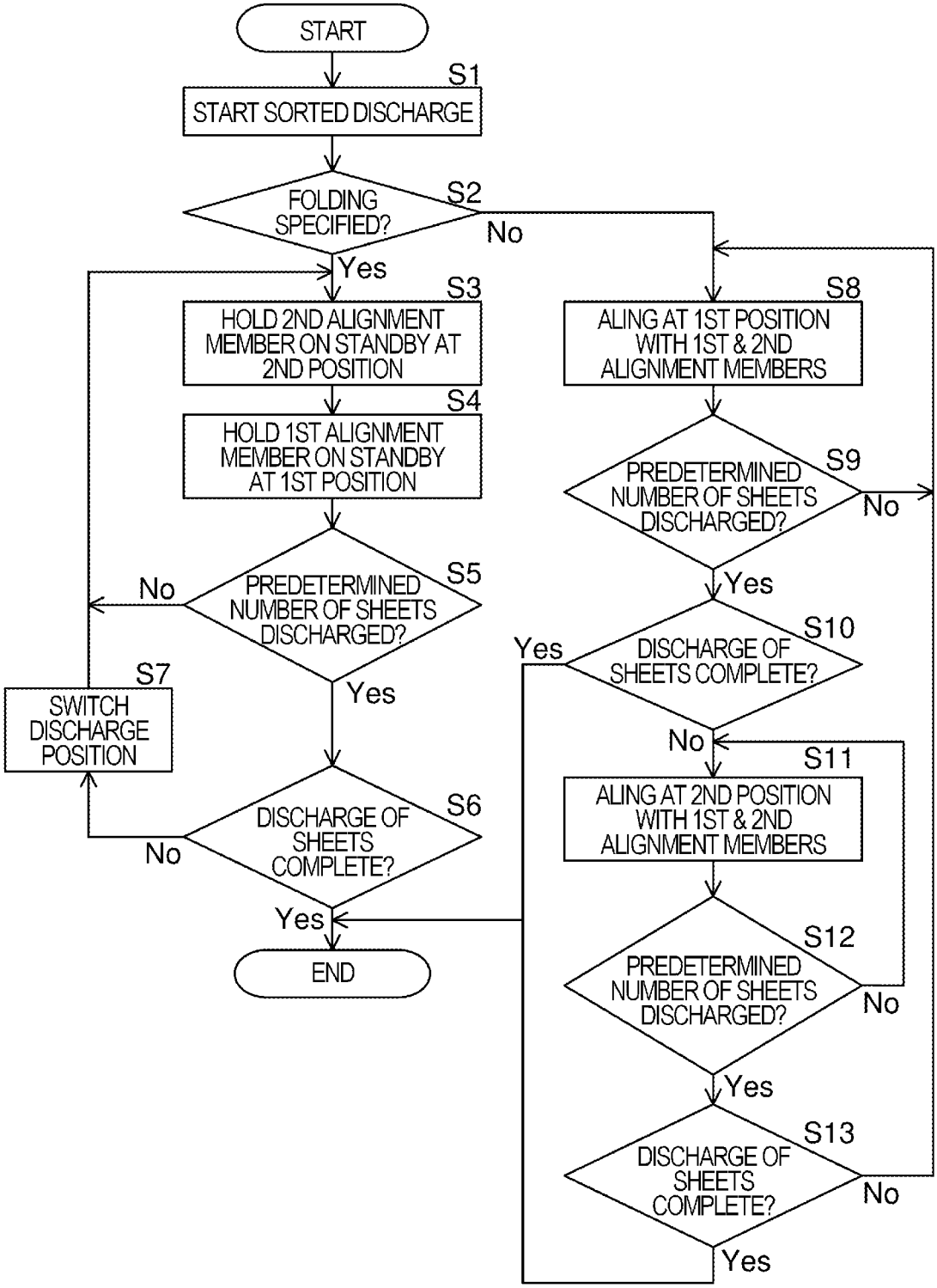
FIG. 11 is a flow chart showing a second example of operation control for the alignment members during sorting on the sheet post-processing device according to the embodiment.

FIG. 11 is a flow chart showing a second example of operation control for the alignment members 51 during sorting on the sheet post-processing device 30. With reference to, as necessary, FIGS. 1 to 8 and also FIG. 12, which will be described later, the alignment operation by the alignment members 51 during sorting will be described through the steps in FIG. 11.

Figure 12:
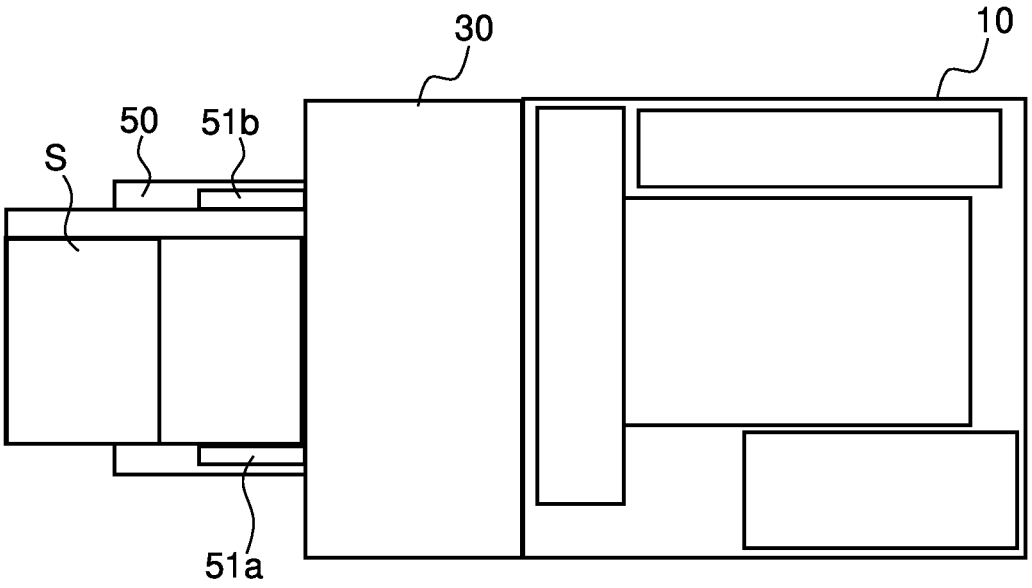
FIG. 12 is a diagram showing how sorting is performed with the first and second alignment members held on standby at the first and second positions respectively, without performing alignment in the example of operation control in FIG. 11.

When sorting starts (step S1), the post-processing controller 101 checks whether folding of sheets S by the first sheet folding unit 60 is specified (step S2). If folding is specified (Step S2, "Yes"), then as shown in FIG. 12, the first alignment member 51*a* is held on standby at the first position (step S3). Likewise the second alignment member 51*b* is held on standby at the second position (step S4). Meanwhile, without being subjected to alignment operation, sheets S are discharged at one side of the sheet width direction (at the near side of the apparatus).

The post-processing controller 101 checks whether a predetermined number of sheets S have been discharged (step S5). If the predetermined number has not been reached (S5, "No"), then back at step S3, the discharge of sheets S at one side in the sheet width direction (at the near side of the apparatus) is continued (steps S3 and S4).

If at step S5 the predetermined number of sheets have been discharged (step S5, "Yes"), whether the discharge of sheets S is complete (step S6) is checked. If the discharge of sheets S is complete (step S6, "Yes"), sorting is ended. If the discharge of sheets S continues (step S6, "No"), the discharge position is switched to the other side in the sheet width direction (the far side of the apparatus). Then, back at step S3, without being subjected to alignment operation, sheets S are discharged (steps S3 to S6).

On the other hand, if at step S2 folding is not specified (step S2, "No"), as in the example of operation control shown in FIG. 9, the first alignment member 51*a* is made to reciprocate between the first position and a position outward of the first position. And, while the second alignment member 51*b* is made to reciprocate between the second position and a position outward of the second position to perform ordinary alignment (in the first alignment mode), sorting is performed so that sheets S are sorted between one side in the sheet width direction (near side of the apparatus) and the other side (the far side of the apparatus) (steps S8 to S13).

In the second example of operation control shown in FIG. 11, if folding of the sheet S is specified, the first and second alignment members 51*a* and 51*b* are held on standby at the first and second positions respectively, and alignment operation is not performed. Thus, if the sheets S have a bulge resulting from folding, it does not occur that the bulging part of the sheets S is caught on a alignment member 51 and is pushed out. It is thus possible, as with the first example of operation control shown in FIG. 9, to suppress irregular stacking of sheets S.

Moreover, without alignment operation by the first and second alignment members 51*a* and 51*b* being performed, while sheets S are stacked (aligned) less neatly, the first and second alignment members 51*a* and 51*b* are located at the first and second positions respectively, and this makes it possible to restrain sheets S from dropping off the main discharge tray 50.

While, in the example of operation control in FIG. 11, the first and second alignment members 51*a* and 51*b* are held on standby at the first and second positions respectively as shown in FIG. 12, the positions at which the first and second alignment members 51*a* and 51*b* are held on standby are not limited to the first and second positions but may be elsewhere near the first and second positions, outward in the sheet width direction.

Figure 13:
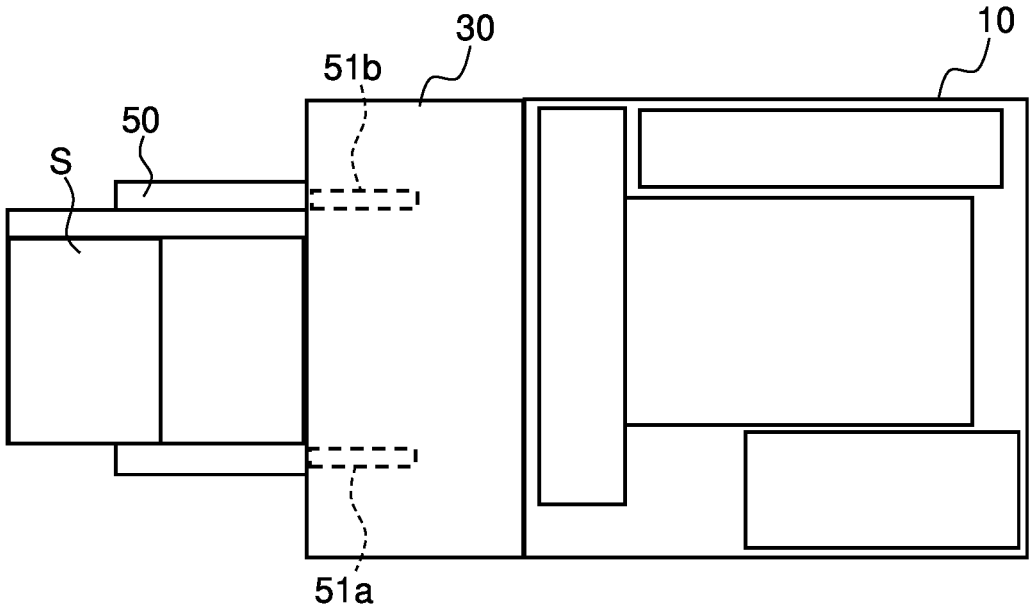
FIG. 13 is a diagram showing how sorting is performed with the first and second alignment members located at retracted positions, without performing alignment.

For example, sorting of sheets S having undergone folding may be performed with the first and second alignment members 51*a* and 51*b* retracted at the retracted position in the sheet post-processing device 30 as shown in FIG. 13. In that case, the first and second alignment members 51*a* and 51*b* do not serve to restrain sheets S from dropping, yet it is still possible to suppress irregular stacking of sheets S resulting from a bulging part of the sheets S being caught on a first alignment member 51 and pushed out.

When sorting is performed with the first and second alignment members 51*a* and 51*b* retracted at the retracted position as shown in FIG. 13, at the start of sorting, sheet information (whether having undergone folding) on the first few sheets is transmitted to the control unit 101 but it is still unknown whether, during the sorting, any sheet S having undergone folding will be discharged. For example, if the first few sheets do not include a sheet S having undergone folding, alignment with the first and second alignment members 51*a* and 51*b* is possible. On the other hand, if, during the shorting, sheet information indicating inclusion of a sheet S having undergone folding is transmitted, the first and second alignment members 51*a* and 51*b* need to be retracted to the retracted position.

During sorting, for example, even if one copy (one bundle) of sheets contains 10 sheets, discharge operation is performed not by performing shifting after 10 sheets are stacked on the processing tray 35 but by performing shifting for each of discharge bundles, each containing a few sheets (two to five sheets), into which one copy is subdivided, that is, in a plurality of smaller bundles discharged separately, on the main discharge tray 50. Accordingly, if the sheet information transmitted to the control unit 101 indicates inclusion of a sheet having undergone folding, it is preferable that the first and second alignment members 51*a* and 51*b* be retracted to the retracted position on completion of the discharge of a discharge bundle including no sheet having undergone folding.

To follow is a description of how, out of a bundle of sheets containing 10 sheets per copy, two copies are discharged while being subdivided into discharge bundles each containing three to four sheets. For example, for a discharge bundle (folded bundle) that includes a sheet S having undergone folding (hereinafter referred to as a folded sheet) as the first or second sheet in the bundle of sheets, before sorting, the first and second alignment members 51*a* and 51*b* are retracted to the retracted position. The first discharge bundle (the first to third sheets, the folded bundle) is introduced to the middle reference position (the middle in the width direction) on the processing tray 35, and is shifted by the shift unit 119 to one side in the sheet width direction (the near side of the apparatus) and then discharged. Likewise, the subsequent, second discharge bundle (the fourth to sixth sheets) is shifted to one side in the sheet width direction (the near side of the apparatus) and discharged. Then the third discharge bundle (the seventh to tenth sheets) is shifted to one side in the sheet width direction (the near side of the apparatus) and discharged. Thus the discharge of the first copy is complete.

Next, with the first and second alignment members 51*a* and 51*b* retracted at the retracted position, the second copy is discharged. The second copy is discharged through a procedure similar to that for the first copy except that it is shifted by the shift unit 119 to the other side in the sheet width direction (the far side of the apparatus) and discharged.

For a discharge bundle (folded bundle) that includes a folded sheet as the third or a following sheet in the bundle of sheets, before the start of sorting, the first and second alignment members 51*a* and 51*b* are moved away from the retracted position to protrude over the main discharge tray 50. Then the first discharge bundle (first to third sheets) is introduced to the middle reference position (the middle in the width direction), and is shifted by the shift unit 119 to one side in the sheet width direction (the near side of the apparatus) and discharged. Next, using the first and second alignment members 51*a* and 51*b*, the first discharge bundle (first to third sheets) is subjected to alignment. Thereafter the first and second alignment members 51*a* and 51*b* are retracted to the retracted position.

Likewise the subsequent, second discharge bundle (fourth to sixth sheets) is shifted to one side in the sheet width direction (near side of the apparatus) and is discharged. Then the third discharge bundle (seventh to tenth sheets) is shifted to one side in the sheet width direction (the near side of the apparatus) and is discharged. Thus the discharge of the first copy is complete.

Next, with the first and second alignment members 51*a* and 51*b* retracted at the retracted position, the second copy is discharged. The second copy is discharged through a procedure similar to that for the first copy except that it is shifted by the shift unit 119 to the other side in the sheet width direction (the far side of the apparatus) and discharged. That is, if at least one of a plurality of discharge bundles is a folded bundle, a discharge bundle that is discharged after the discharge of the folded bundle that is the first to be discharged is discharged with the first and second alignment members 51*a* and 51*b* retracted at the retracted position, and hence without being subjected to alignment.

Through the procedure described above, even when a bundle of sheets to be sorted includes a folded sheet, alignment with the alignment members 51 is possible up to the discharge bundle immediately before the one that includes a folded sheet. It is thus possible to restrain a bump on sheets S from being caught on a first alignment member 51 and pushed out, and meanwhile to perform alignment with the alignment members 51 whenever possible.

The embodiment described above is in no way meant to limit the present disclosure, which can thus be implemented with many modifications made without departure from the spirit of the present disclosure. For example, while the embodiment described above deals with an example where the first sheet folding unit 60 includes a pair of folding rollers 64 and a pair of first conveyance rollers 65 composed of three rollers, namely a first to a third roller 63*a* to 63*c*, this is not meant as any limitation. Instead, for example, the first sheet folding unit 60 may include only a pair of folding rollers 64 composed of a first and a second roller 63*a* and 63*b*.

While the embodiment described above deals with a configuration where a sheet post-processing device 30 includes inside it a first sheet folding unit 60 and a sheet S having undergone folding is discharged onto a main discharge tray 50 located downstream of the first sheet folding unit 60, instead a sheet folding device (not illustrated) as a separate unit may be coupled between the image forming apparatus 10 and the sheet post-processing device 30 so that sheets having undergone folding by the sheet folding device are introduced into the sheet post-processing device 30.

While the embodiment described above deals with, as one example of the image forming apparatus 10, a multifunction peripheral as shown in FIG. 1, a sheet post-processing device 30 according to the present disclosure can be coupled to any image forming apparatus other than a digital multifunction peripheral, such as a laser printer, an inkjet printer, or a facsimile machine.

What is claimed is:

1. A sheet post-processing device, comprising:

a folding portion that applies a predetermined folding process to a sheet;

a discharge portion that discharges the sheet through a sheet discharge port;

a stacking tray on which the sheet discharged through the sheet discharge port is stacked;

a shift unit that shifts a discharge position of the sheet on the stacking tray in a sheet width direction orthogonal to a discharge direction;

a pair of alignment members including a first alignment member disposed at one side in the sheet width direction so as to be reciprocatable in the sheet width direction and a second alignment member disposed at another side in the sheet width direction so as to be reciprocatable in the sheet width direction, the pair of alignment members configured to contact the sheet stacked on the stacking tray to align a position of the sheet in the sheet width direction; and a controller that controls the folding portion, the shift unit, and the pair of alignment members, wherein the controller performs an alignment process in which the controller makes the pair of alignment members reciprocate between a predetermined aligning position and a position outward of the aligning position with respect to the sheet width direction, thereby to align the sheet discharged at a predetermined discharge position on the stacking tray and a sorting process in which the controller, when a plurality of copies of sheet bundles each including a plurality of the sheets are discharged, drives the shift unit to shift the discharge position of the sheet bundles discharged on the stacking tray alternately, between a first shift position at one side in the sheet width direction and a second shift position at another side in the sheet width direction, in the sorting process, the alignment process is performed in a state where the first alignment member disposed at a first position corresponding to the first shift position and the second alignment member disposed at a second position corresponding to the second shift position, when the sheet bundle stacked on the stacking tray does not include the sheet subjected the folding process, executes a first alignment mode in which the alignment process is performed with the first and second alignment members, when the sheet bundles stacked on the stacking tray includes the sheet subjected the folding process, executes a second alignment mode in which, for the sheet bundle shifted to the first shift position, the alignment process is performed with only the first alignment member and for the sheet bundle shifted to the second shift position, the alignment process is performed with only the second alignment member, or does not perform the alignment process.

2. The sheet post-processing device according to claim 1, wherein in the sorting process, if the sheet bundle subjected to Z-folding is discharged through the sheet discharge port onto the stacking tray, the controller either performs the second alignment mode or does not perform the alignment process.

3. The sheet post-processing device according to claim 1, wherein when the controller does not perform the alignment process in the sorting process, in a state where the first alignment member is located at the first position and with the second alignment member is located at the second position, the controller discharges the sheet bundle at the first and second shift positions.

4. The sheet post-processing device according to claim 3, wherein when the controller performs the second alignment mode, when discharging the sheet at the first shift position, with the second alignment member held at the second position, the controller performs the alignment process by making only the first alignment member reciprocate between the first position and a position outward of the first position in the sheet width direction and, when discharging the sheet at the second shift position, with the first alignment member held at the first position, the controller performs the alignment process by making only the second alignment member reciprocate between the second position and a position outward of the second position in the sheet width direction.

5. The sheet post-processing device according to claim 1, wherein the first and second alignment members can be retracted to respective retracted positions in a main body of the sheet post-processing device, and when the controller does not perform the alignment process, with the first and second alignment members retracted at the respective retracted positions, the controller discharges the sheet bundle including the sheet subjected to the folding process at the first and second shift positions.

6. The sheet post-processing device according to claim 5, wherein in the sorting process, the controller discharges the sheet bundle in a form divided into a plurality of discharge bundles, and in a case where, the plurality of discharge bundles includes at least a folded bundle that includes the sheet subjected to the folding process, the controller, when discharging the sheet bundles that are discharged after at least the folded bundle, keeps the first and second alignment members at the respective retracted positions and does not perform the alignment process.

* * * * *